US006631913B2

(12) United States Patent
Godfrey

(10) Patent No.: US 6,631,913 B2
(45) Date of Patent: Oct. 14, 2003

(54) DETACHABLE INTERCHANGEABLE SKATEBOARD

(76) Inventor: Alonzo Edward Godfrey, 29 N. 28th St., Las Vegas, NV (US) 89101

( * ) Notice: Subject to any disclaimer, the term of this patent is extended or adjusted under 35 U.S.C. 154(b) by 0 days.

(21) Appl. No.: 10/032,904

(22) Filed: Oct. 19, 2001

(65) Prior Publication Data

US 2002/0117824 A1 Aug. 29, 2002

Related U.S. Application Data

(63) Continuation-in-part of application No. 09/439,182, filed on Nov. 12, 1999, now abandoned.

(51) Int. Cl.[7] ..... A63C 17/00
(52) U.S. Cl. ..... 280/87.05; 280/87.041
(58) Field of Search ..... 280/87.042, 87.05, 280/87.041, 87.021

(56) References Cited

U.S. PATENT DOCUMENTS 4,076,267 A * 2/1978 Lipscomb ..... 280/87.04
4,155,565 A * 5/1979 De Caussin et al. ..... 280/87.04
4,915,403 A * 4/1990 Wild et al. ..... 280/221
5,505,474 A * 4/1996 Yeh ..... 280/87.042
5,540,455 A * 7/1996 Chambers ..... 280/87.042
6,158,752 A * 12/2000 Kay ..... 280/87.042
6,273,440 B1 * 8/2001 Wilson ..... 280/87.042

* cited by examiner

*Primary Examiner*—Lesley D. Morris
*Assistant Examiner*—Tony Winner

(57) ABSTRACT

The evolution of this vehicle makes this a new form of skateboard that can be broken down: into two parts to be carried with ease. The upper platform can be removed and substituted for another; this allows the rider to replace worn parts for another such as the upper platform. Once the rider places the upper platform on top of the lowerplatform, the halves slide into the (H) shapelocking brace. Once the halves are fully secure a holding fastener locks the halves so no movement is allowed.

3 Claims, 15 Drawing Sheets

DETACHABLE INTERCHANGEABLE SKATEBOARD

CROSS-REFERENCES TO RELATED APPLICATIONS

This application is a continuation in part of application Ser. No. 09439182 file on Nov. 12, 1999 , now abandoned.

| Field of seach | U.S. PATENT DOCUMENTS | 280/87/042 |
|---|---|---|
| 4,076,267 * 2/1978 | Lipscomb | 280/87.04 |
| 4,915,403 * 4/1990 | Wild et al al | 280/221 |
| 5,505,474 * 4/1996 | Yeh | 280/87042 |
| 5,540,455 * 7/1996 | Chambers | 280/87.042 |
| 6,158,752 * 12/2000 | Kay | 280//87.042 |

221 ,87,04, 87,04 87,042 87042 87,042 87,042

BACKGROUND OF THE INVENTION

1. Field of the Invention

This invention relates to an improved and new form of skateboard and has the ability to let the skateboard rider detach the skateboard so it can be carried with ease. It allows worn parts to be replaced without having to buy a hold new skateboard. The skateboard consist of an (H)shape lockingbrace, two upperplatforms, two lowerplatforms, two rubber boarders, and a holding fastner 2. Description of Related ARtArt U.S. Pat. No. 5,40,455 Made by Chambers has a prior device, which is comprised of a metal spring when rider gets on the skateboard and the metal springs allow the board to bend and return to original form. The major draw back to such a skateboard is that its to bulky; for all those who commute with their skateboard for school, work, and any other place

SUMMARY OF INVENTION

This application is a continuation in part of application Ser. No. 09439182 file on Nov. 12, 1999.

The skateboard that i've created is far different than that of any skateboard ever invented; i've made it to be detachable so the users could can carry it with ease. The two halves of the skateboard slide into the H shape locking brace. Once the halves are secure in the locking brace a holding fastener holds the two halves so no movement is allowed. It also has the ability to have it's upper platforms changed. This gives a variety of different looks as well as being able to change worn parts. Rubber boarders are attached at each end of the halves of the skateboard to allow less damage like chipping, this will give the skateboard longevity.

DETAILED DESCRIPTION OF INVENTION

This application is a continuation in part of application Ser. No. 09439182 file on Nov. 11, 1999.

Figure 1:
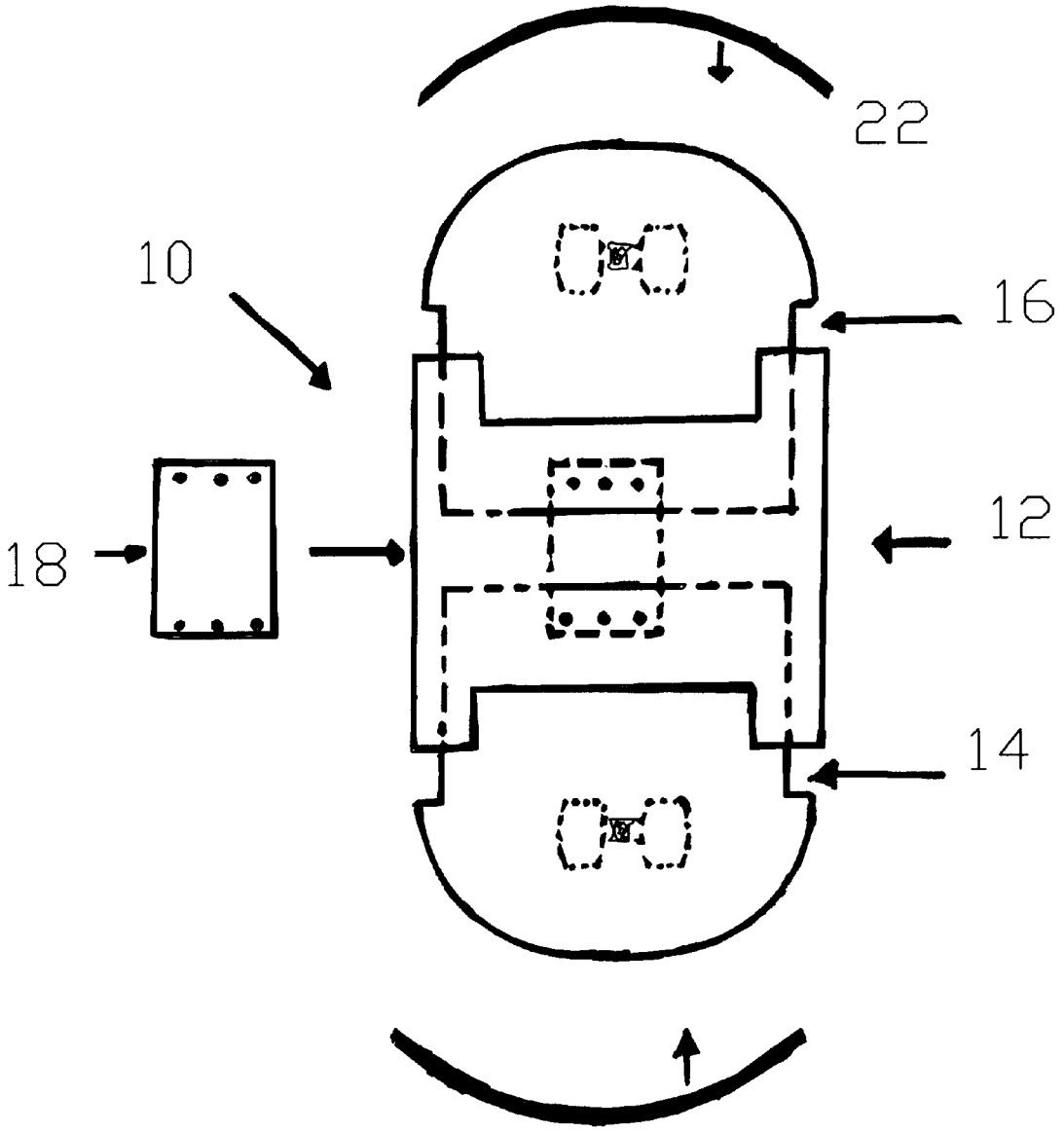
In FIG. 1: An illustrated view of the skateboard. There is a perspective view of the detachable interchangeable skateboard, which is made up of ten components. Components 24, 26, 28, and 30 are not seen.

In FIG. 1, the Number 10 designates the new detachable interchangeable skateboard.

In this view the skateboard, which is composed of:

| | |
|---|---|
| 12: | H-shaped locking brace |
| 14 and 16: | two upper platforms |
| 20 and 22: | rubber borders |
| 24 and 26: | two lower platforms (not seen) |
| 28 and 30: | wheel assembly |
| 18: | a holding fastener |

all of which make up this unique device.

Figure 2:
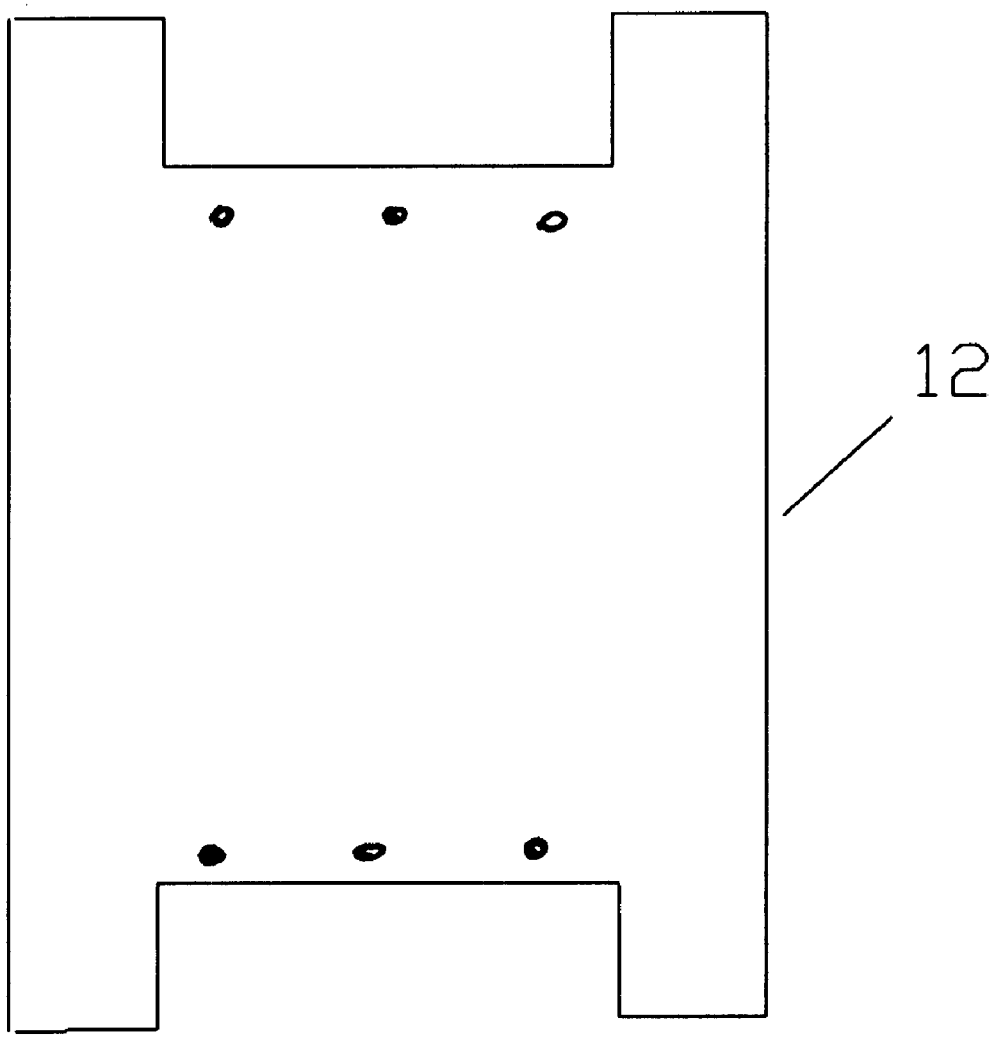
In FIG. 2: The H-shaped brace is seen in the front top view.
Figure 2A:
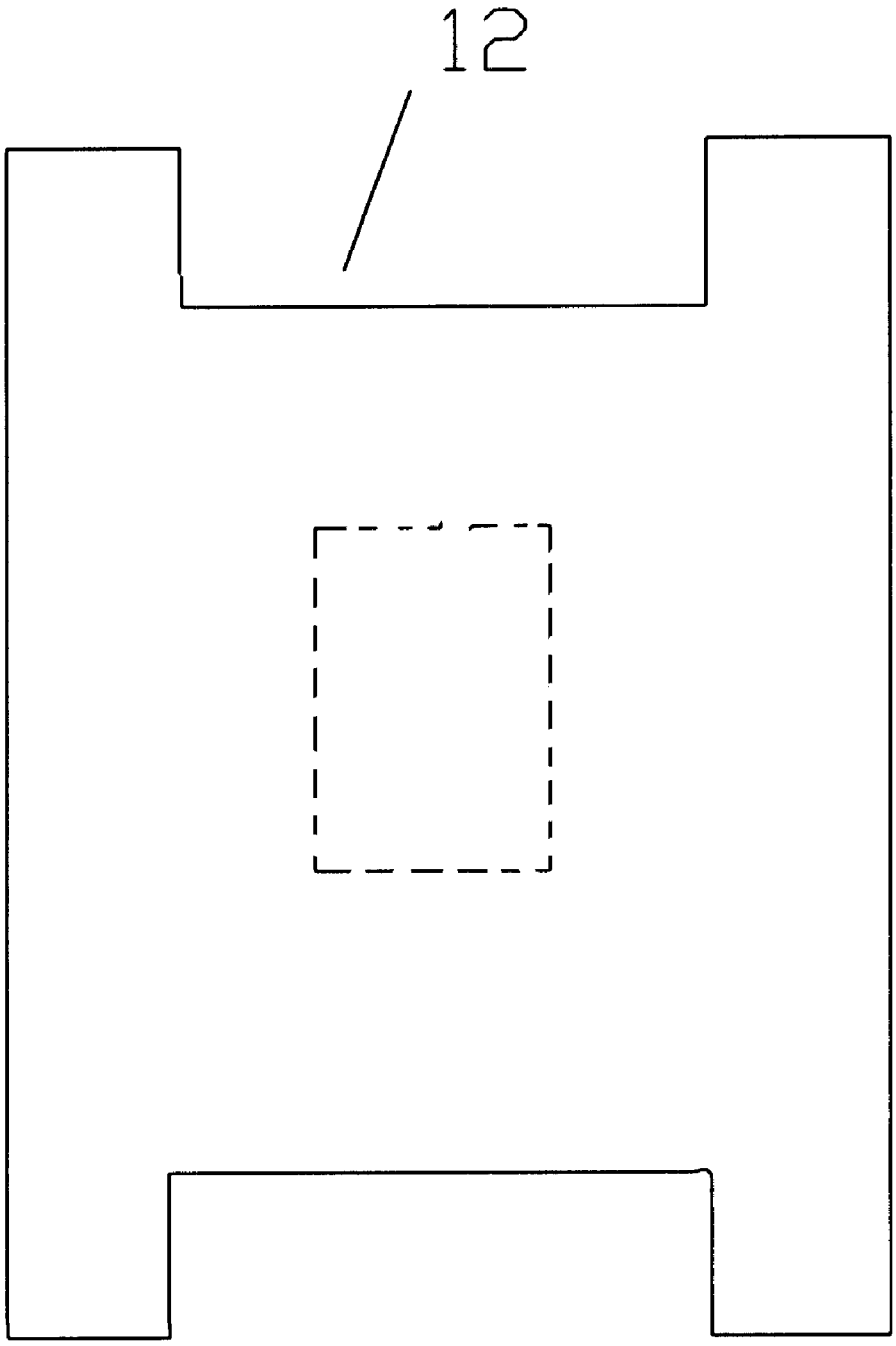
In FIG. 2A: The H-shaped brace is seen in an upside-down view, showing the bottom of the brace.
Figure 3:
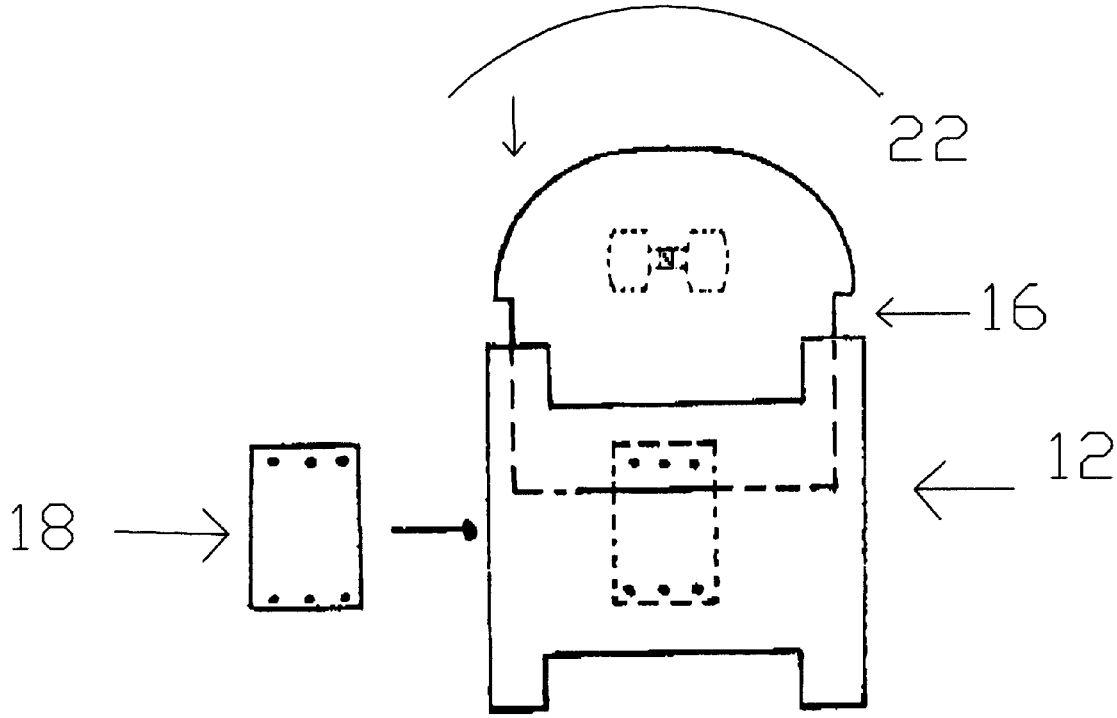
In FIG. 3: The skateboard is seen half-connected. This will give an understanding view of how the device works. Components 14, 20, 24, 26, 28, and 30 are not seen.
Figure 3A:
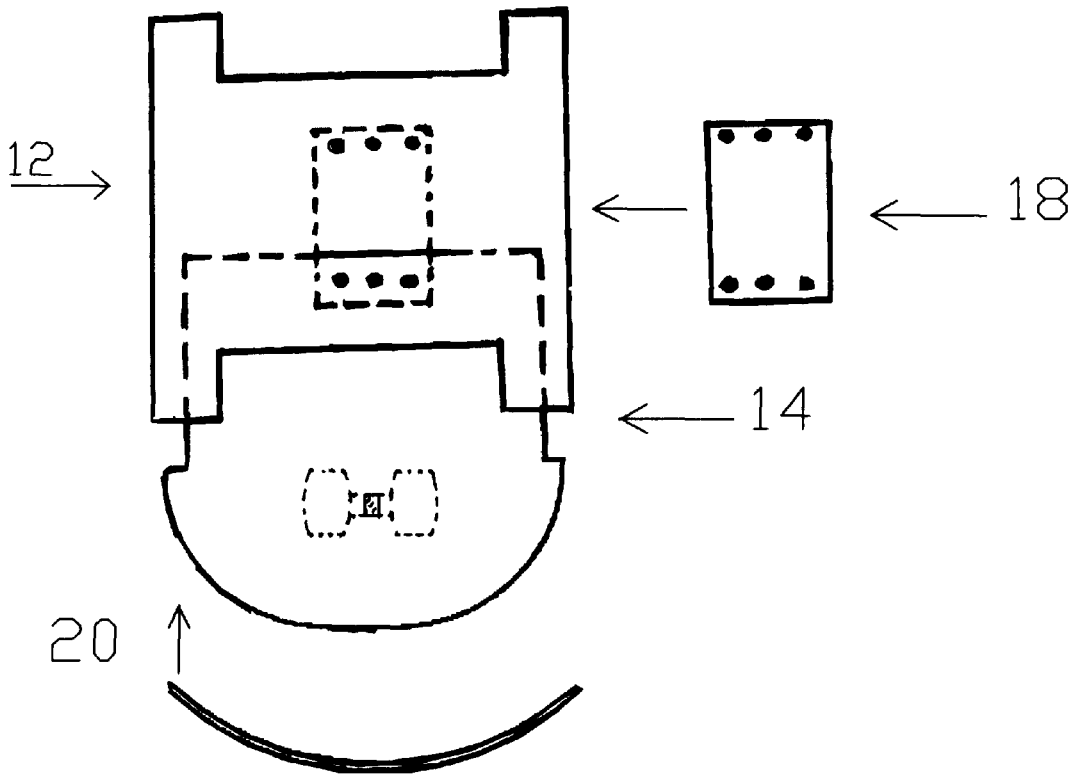
In FIG. 3A: The skateboard is seen half connected again, but components 16, 22, 24, 26, 28, and 30 are not seen.
Figure 4:
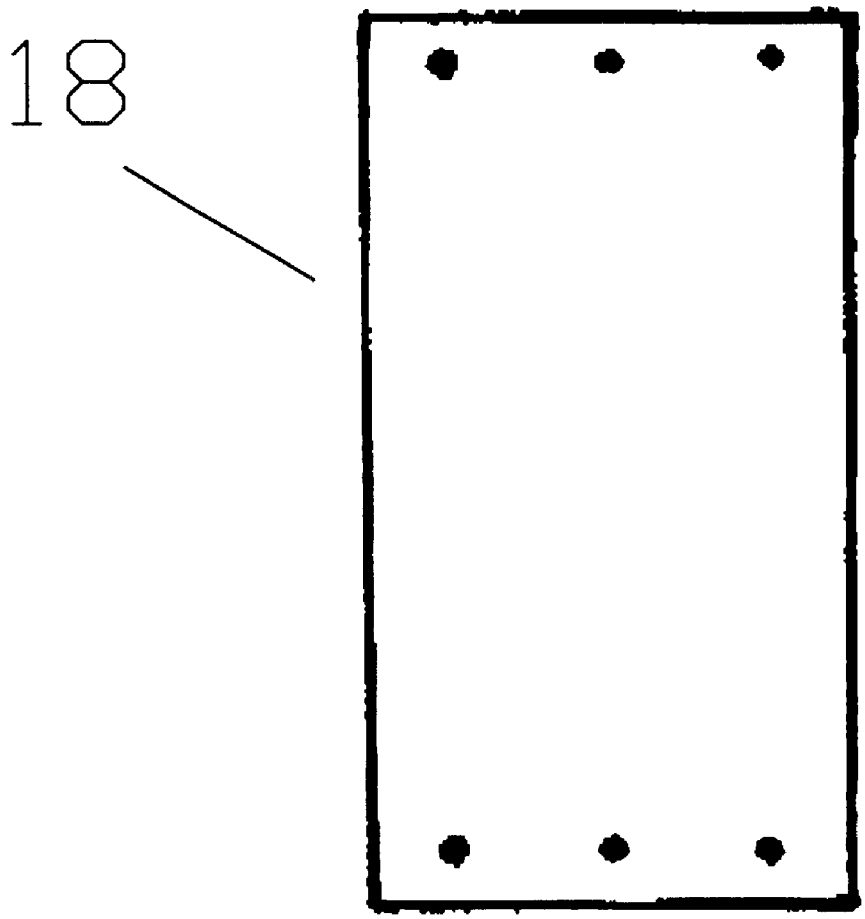
In FIG. 4: A perspective view of the holding fastener 18 is shown from a top view.
Figure 4A:
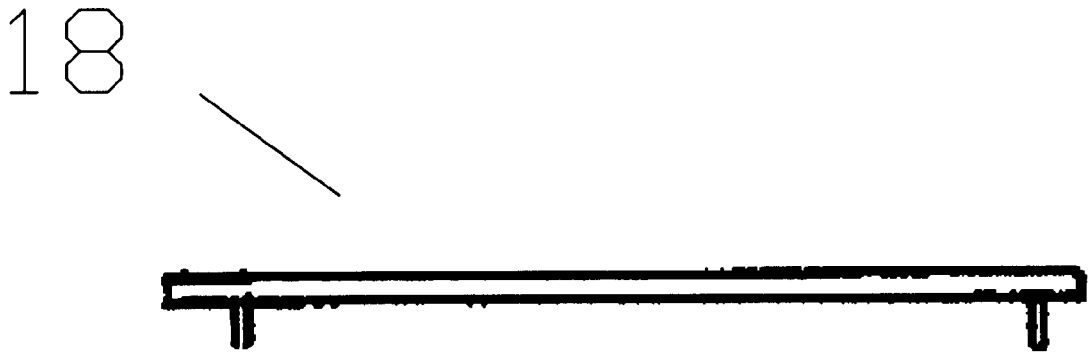
In FIG. 4A: A side view of the holding fastener 18 is shown.
Figure 5:
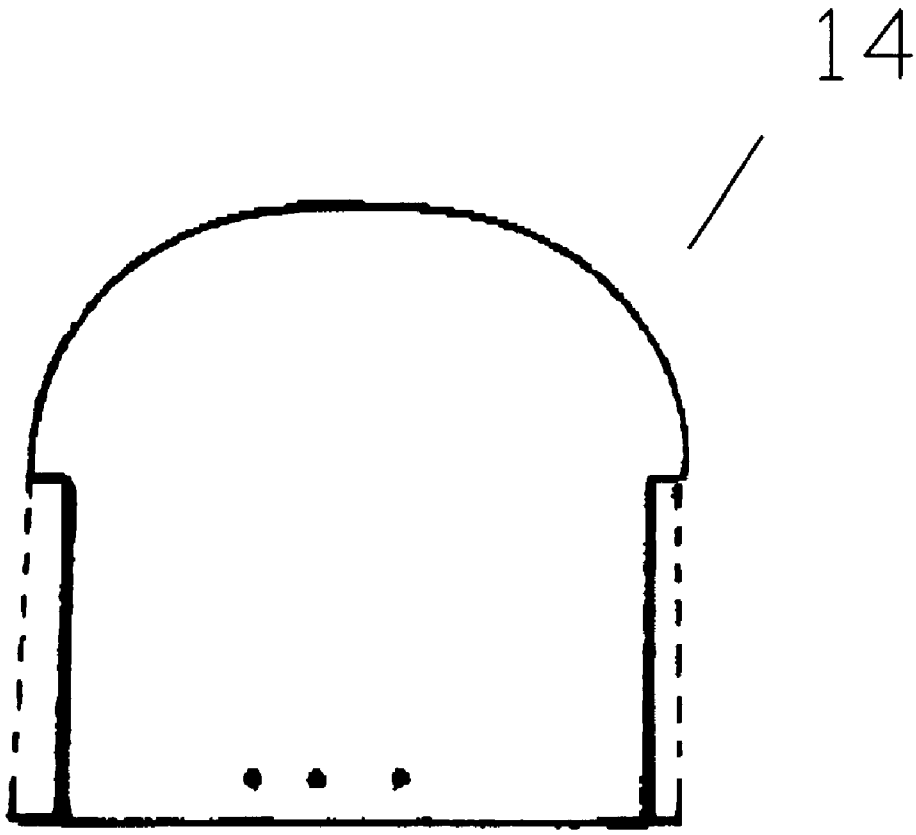
In FIG. 5: Upper platform is shown from a top view.
Figure 6:
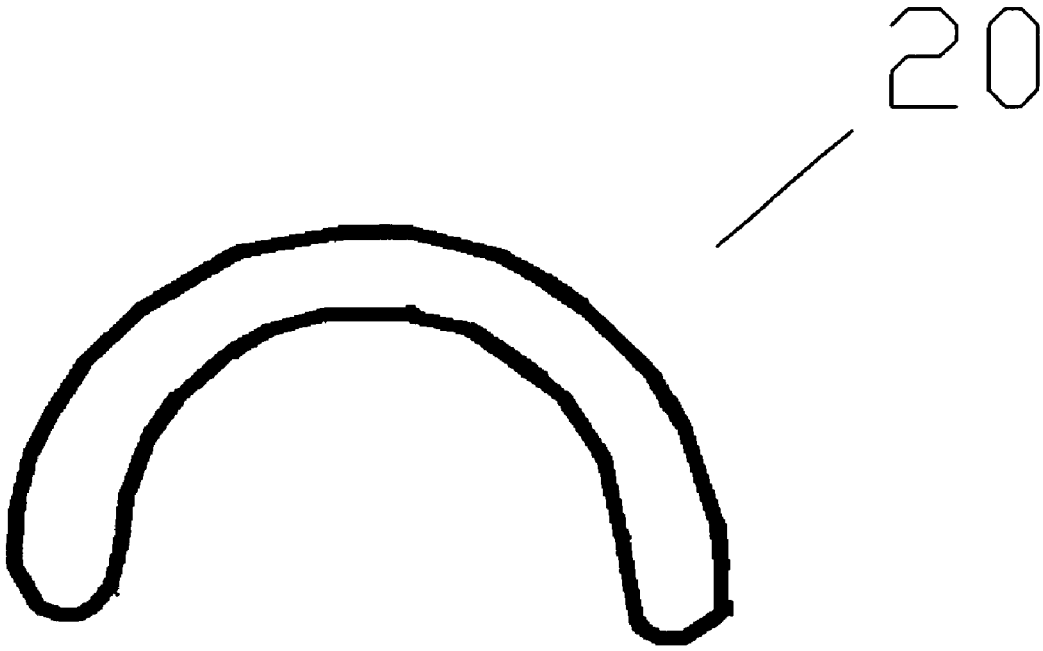
In FIG. 6: Rubber border is shown from a top view.
Figure 7:
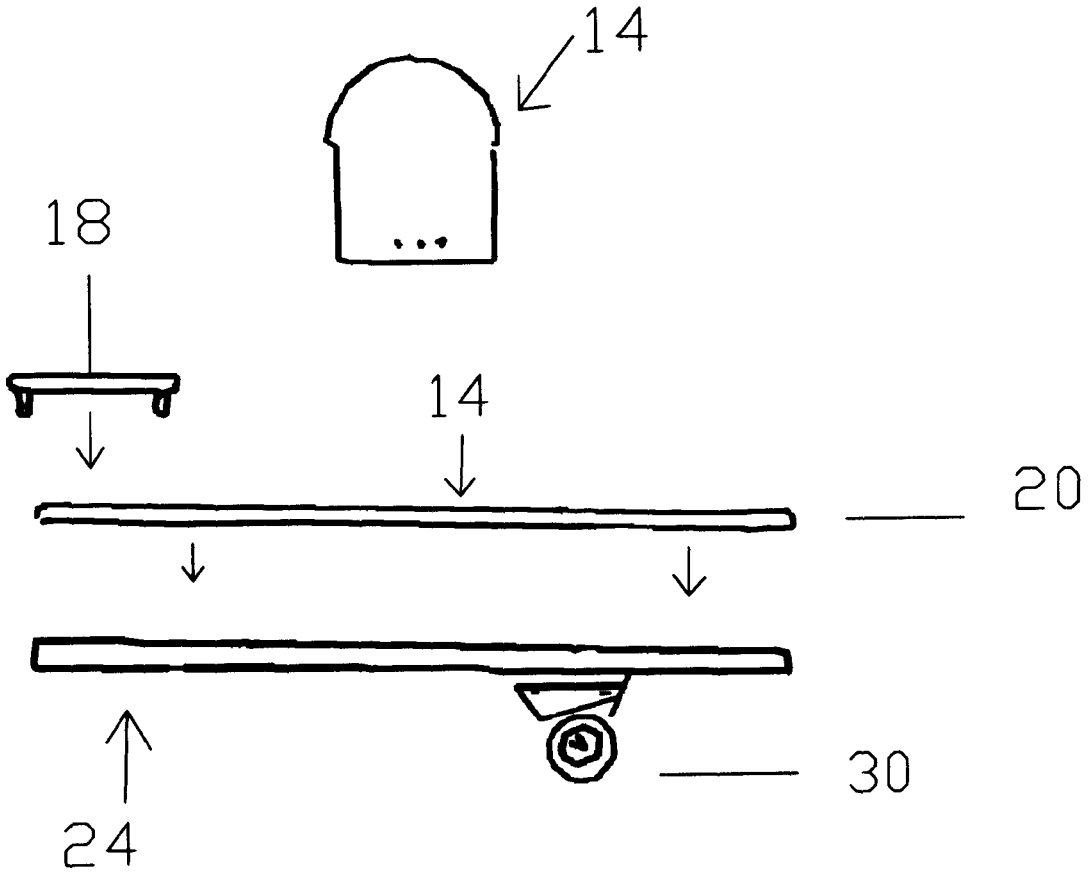
In FIG. 7: A side view of the lower platform and wheel assembly is shown with upper platform and holding fastener In FIG. 8: A left-hand side view of the lower platform and wheel assembly is shown with upper platform and holding fastner.
Figure 8:
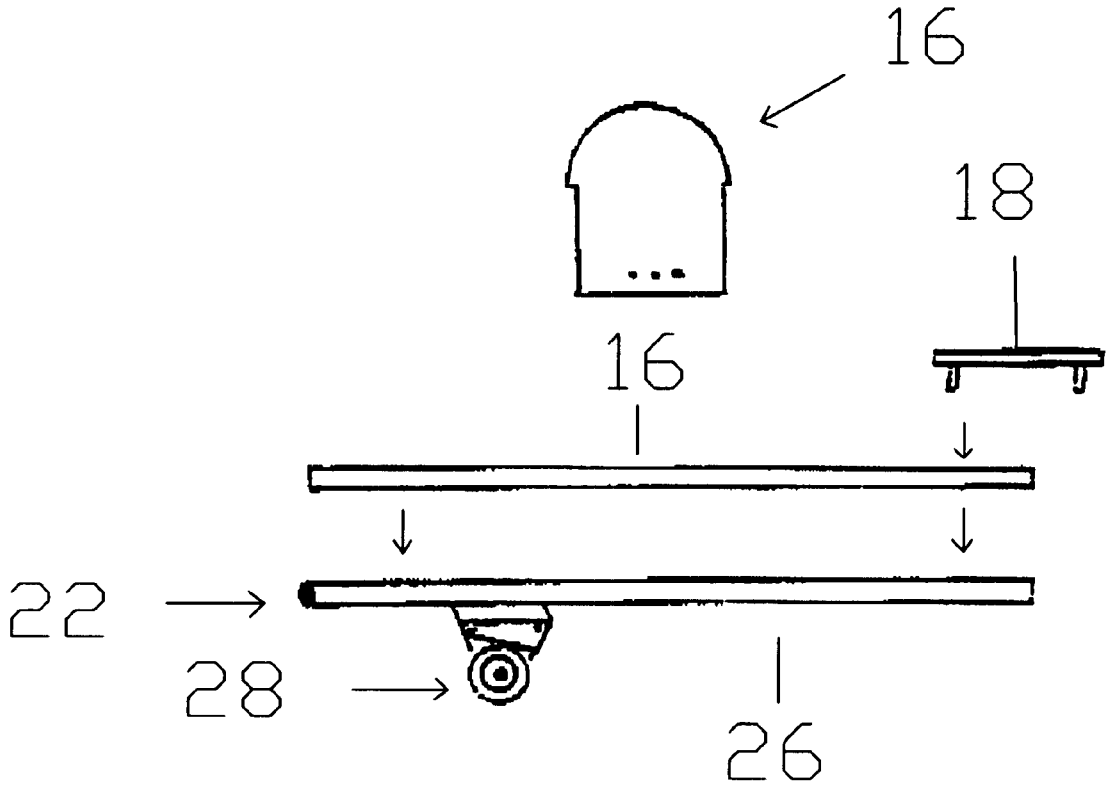
Figure 9:
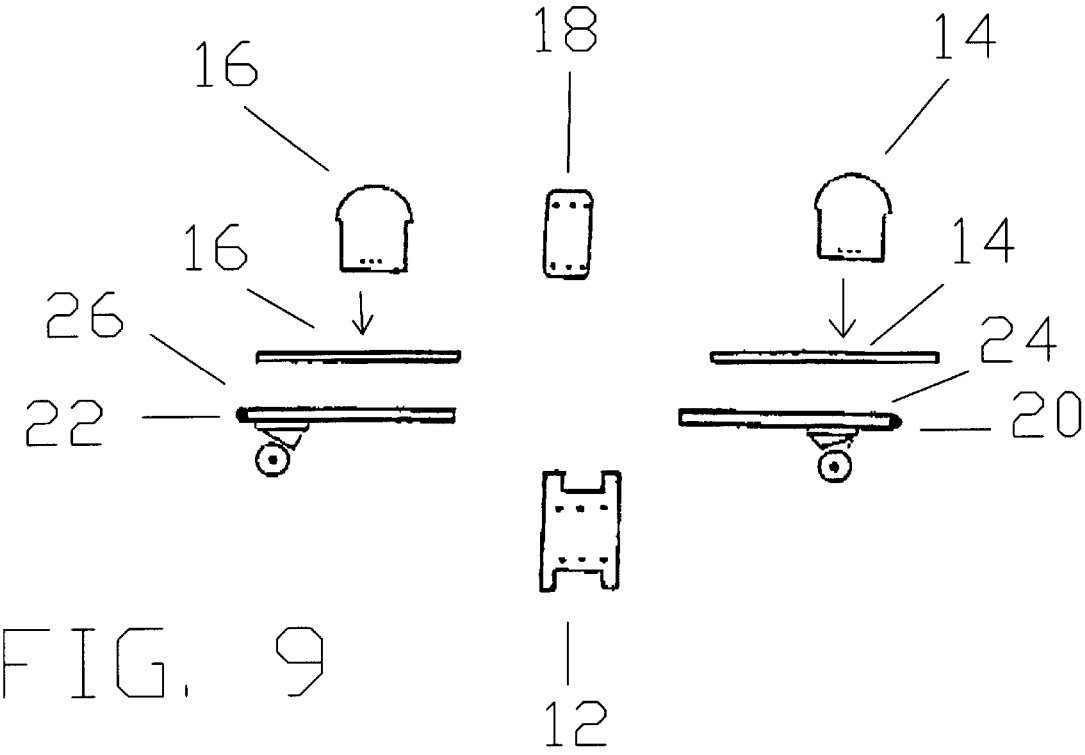
In FIG. 9: A disassemble side view of whole skateboard is shown.
Figure 10:
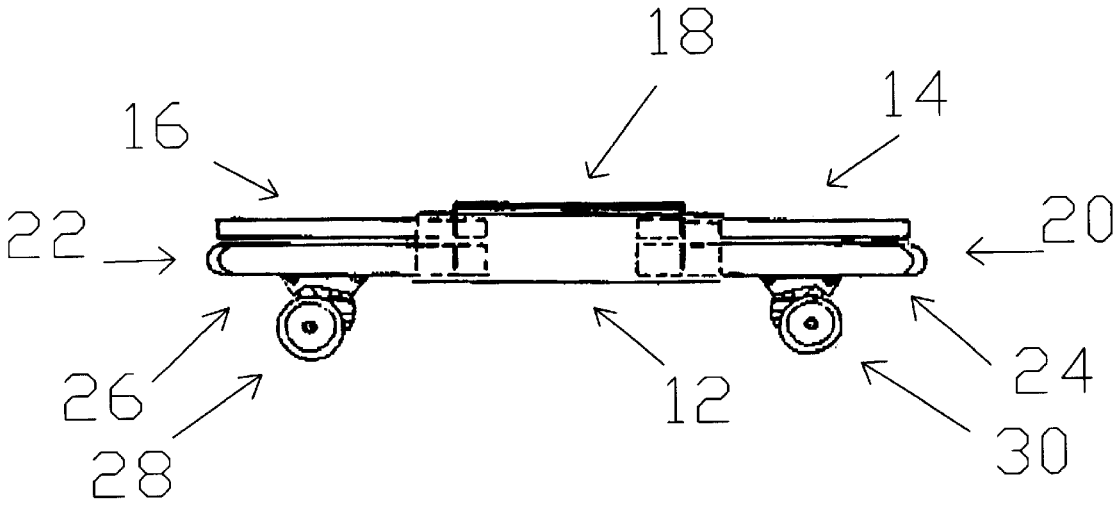
In FIG. 10: A side view of whole skateboard is shown.
Figure 11:
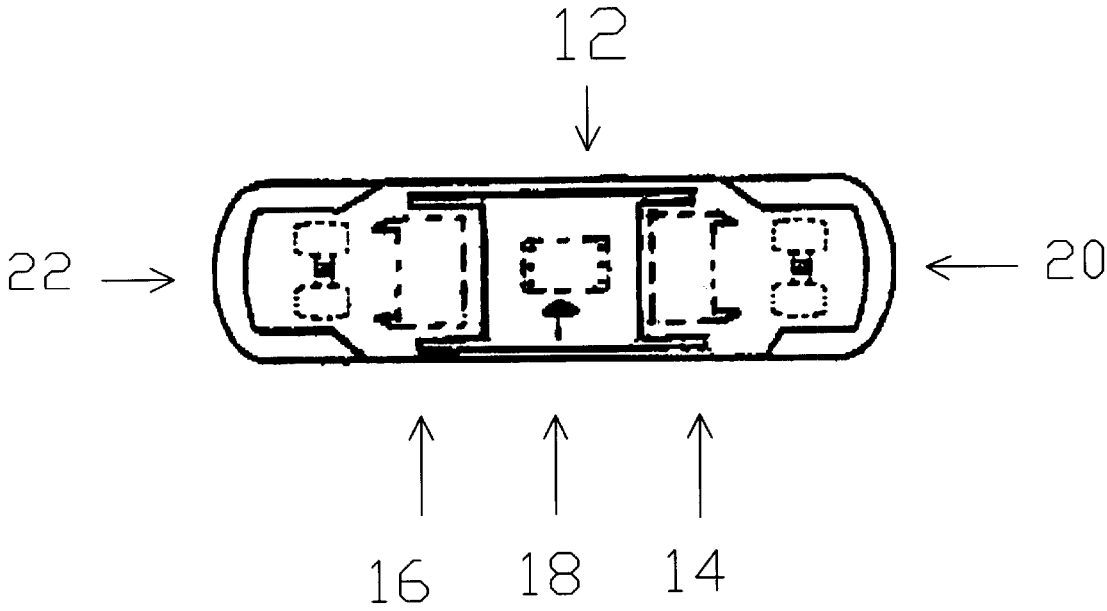
In FIG. 11: A assemble whole view of skateboard is shown from a top view.
Figure 12:
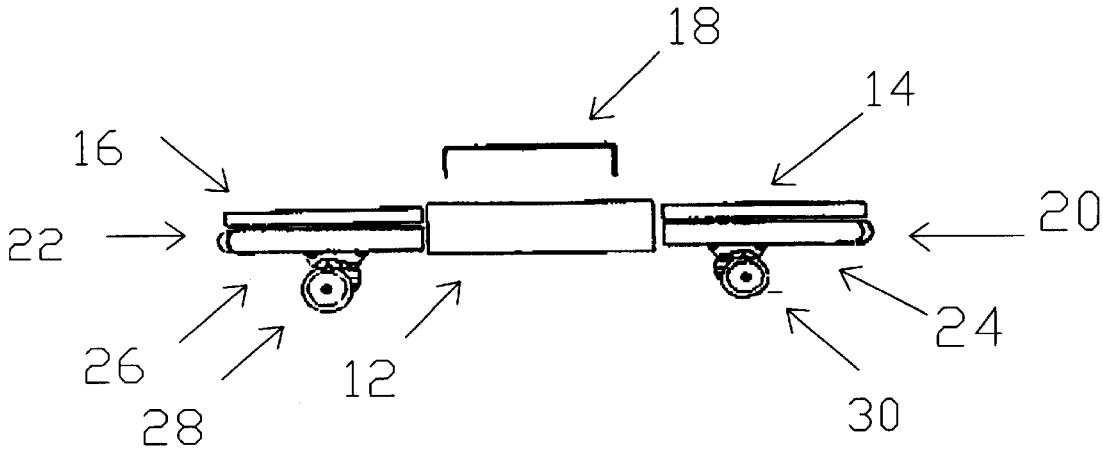
In FIG. 12: A side view of whole skateboard is shown with holding fastner unattached.

On each end of the skateboard halves there are rubber borders 20 and 22. Components 14 and 16 (upper platforms) are placed on top of 24 and 26 (lower platforms). Once this is done, the process of inserting them in must take place. The hollow H-shaped locking brace 12 has components 14, 16, 24, and 26 inserted into it. Once fully inserted, the components start to form a unique riding device. The holding fastener 18 is placed in the middle of the H-shaped locking braces 12, which holds all components in a sturdy manner. In FIG. 2, whole view of the H-shapedlocking brace 12 is seen. This device is the heart of the skateboard 10.

The H-shaped locking brace unites all components. One of the most unique concepts of this invention is the upper platform 14 and 16. These replaceable platforms allow the skateboard 10 the ability to change its look, as well as being able to replace a worn part. The holding fastener 18 plays a big hand in uniting the components that make up the skateboard 10. The holding fastener, which has an extended prong, is placed on top the H-shaped locking brace 12. The prong extends through the upper platforms 14 and 16 and the lower platforms 24 and 26. The two lower platform halves 24 and 26 have wheel assemblies 28 and 30 attached.

I claim:

1. A detachable skate board comprising:

a. An H-shaped housing with a first and a second ends, b. A front portion has a top and bottom layers with a first and a second ends, said second end of the front portion is inserted into the first end of the H-shaped housing;

c. A rear portion has a top and a bottom layers with first and second ends, said first end of rear portion is inserted into the second end of the H-shaped housing; a fastener is placed on the mid-section of the housing to prevent the front and rear portions from sliding out of the housing.

2. A detachable skate board as recited in claim 1, wherein end guards are attached to both ends of said front and rear portion to protect the ends from damage.

3. A detachable skate board as recited in claim 2, said end guards are made of rubber.

* * * * *